US008783684B2

(12) United States Patent
Hongo et al.

(10) Patent No.: US 8,783,684 B2
(45) Date of Patent: Jul. 22, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/966,778

(22) Filed: Aug. 14, 2013

(65) Prior Publication Data

US 2014/0077447 A1 Mar. 20, 2014

(30) Foreign Application Priority Data

Sep. 14, 2012 (JP) ..... 2012-203557

(51) Int. Cl.
*B65H 7/02* (2006.01)

(52) U.S. Cl.
USPC ..... 271/259; 271/258.01; 271/265.01; 271/265.02

(58) Field of Classification Search
CPC ..... B65H 2511/514; B65H 7/06; B65H 2706/1311; B65H 2701/1313; G03G 15/70
USPC ..... 271/258.01, 259, 265.01, 265.02
See application file for complete search history.

(56) References Cited

U.S. PATENT DOCUMENTS 4,022,460 A 5/1977 Pritchett
7,934,722 B2 5/2011 Namikawa
8,567,777 B2 10/2013 Syracuse et al.
8,585,050 B2 11/2013 Syracuse et al.
2003/0006550 A1 1/2003 Chujo et al.
2005/0269759 A1 12/2005 Sano et al.
2007/0070456 A1 3/2007 Nishimura (Continued)

FOREIGN PATENT DOCUMENTS

JP 57-169767 10/1982
JP 60-112547 6/1985

(Continued)

OTHER PUBLICATIONS

Office action mailed Jul. 9, 2013 for JP 2012-185273 including English translation, 7pp.

(Continued)

*Primary Examiner* — Prasad Gokhale
(74) *Attorney, Agent, or Firm* — Christie, Parker & Hale, LLP.

(57) ABSTRACT

There are provided a paper conveying apparatus, a jam detection method and a computer-readable, non-transitory medium that can suppress erroneous detection of a jam. The paper conveying apparatus includes a sound signal generator for generating a sound signal, a sound jam detector for determining whether a jam has occurred based on the sound signal, a special sound detector for determining whether a special sound has been generated based on a component of the sound signal, and a control module for performing abnormal processing when the sound jam detector determines that a jam has occurred and the special sound detector determines that a special sound has not been generated, and determining that no jam has occurred and not performing the abnormal processing when the sound jam detector determines that a jam has occurred and the special sound detector determines that a special sound has been generated.

11 Claims, 15 Drawing Sheets

(56) References Cited

U.S. PATENT DOCUMENTS

| | | | | |
|---|---|---|---|---|
| 2008/0224390 | A1 | 9/2008 | Ma et al. | |
| 2009/0022536 | A1 | 1/2009 | Takeshita et al. | |
| 2009/0190939 | A1 | 7/2009 | Satoh et al. | |
| 2010/0272460 | A1 | 10/2010 | Zona et al. | |
| 2011/0238423 | A1 | 9/2011 | Schaertel et al. | |
| 2012/0235929 | A1 | 9/2012 | Hongo et al. | |
| 2013/0093136 | A1 | 4/2013 | Sakharshete et al. | |
| 2013/0140757 | A1 | 6/2013 | Phinney et al. | |
| 2013/0140766 | A1* | 6/2013 | Syracuse et al. | 271/262 |
| 2014/0054841 | A1* | 2/2014 | Morikawa et al. | 271/10.01 |
| 2014/0054849 | A1* | 2/2014 | Morikawa et al. | 271/264 |
| 2014/0054851 | A1* | 2/2014 | Morikawa et al. | 271/264 |
| 2014/0054852 | A1 | 2/2014 | Hongo et al. | |
| 2014/0061995 | A1 | 3/2014 | Shimazu | |
| 2014/0062008 | A1 | 3/2014 | Hongo et al. | |
| 2014/0062009 | A1 | 3/2014 | Hongo et al. | |
| 2014/0077445 | A1* | 3/2014 | Morikawa et al. | 271/264 |
| 2014/0077446 | A1* | 3/2014 | Hongo et al. | 271/264 |

FOREIGN PATENT DOCUMENTS

| | | |
|---|---|---|
| JP | 61-169983 | 7/1986 |
| JP | 11-053602 | 2/1999 |
| JP | 2001-302021 | 10/2001 |
| JP | 2002-205449 | 7/2002 |
| JP | 2003-295707 | 10/2003 |
| JP | 2006-322947 | 11/2006 |
| JP | 2007-079263 | 3/2007 |
| JP | 2008-290288 | 12/2008 |
| JP | 2009-249046 | 10/2009 |
| JP | 2011-112665 | 6/2011 |
| JP | 2012-131579 | 7/2012 |

OTHER PUBLICATIONS

Office action mailed Jul. 9, 2013 for JP 2012-185355 including English translation, 5pp.

Office action mailed Jul. 9, 2013 for JP 2012-185358 including English translation, 4pp.

Office action mailed Jul. 9, 2013 for JP 2012-185378 including English translation, 8pp.

Office action mailed Jul. 9, 2013 for JP 2012-203466 including English translation, 7pp.

Office action mailed Jul. 9, 2013 for JP 2012-203557 including English translation, 7pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-203557, filed on Sep. 14, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A paper jam detection device which detects a jam by a specific frequency component which is included in a jam sound has been disclosed (see Japanese Laid-Open Patent Publication No. 2001-302021).

SUMMARY

In the past, sometimes it was mistakenly determined that a jam had occurred due to the sound of contact between a rubber member provided at the outer circumferential surface of a paper feed roller and a paper, the sound of conveyance of a paper which has wrinkles, and other sounds which are caused other than by a jam.

Accordingly, it is an object of the present invention to provide a paper conveying apparatus and a jam detection method that can suppress mistaken detection of the occurrence of a jam and a computer-readable, non-transitory medium storing a computer program for causing a computer to implement such a jam detection method.

According to an aspect of the apparatus, there is provided a paper conveying apparatus. The paper conveying apparatus includes a sound signal generator, provided with a sound detector near a conveyance path of a paper, for generating a sound signal, a sound jam detector for determining whether a jam has occurred based on the sound signal, a special sound detector for determining whether a special sound has been generated based on a component of the sound signal, and a control module for performing abnormal processing when the sound jam detector determines that a jam has occurred and the special sound detector determines that a special sound has not been generated, and determining that no jam has occurred and not performing the abnormal processing when the sound jam detector determines that a jam has occurred and the special sound detector determines that a special sound has been generated.

According to an aspect of the method, there is provide a jam detection method. The jam detection method includes acquiring a sound signal, determining whether a jam has occurred based on the sound signal, determining whether a special sound has been generated based on a component of the sound signal, performing, by a computer, abnormal processing when determining that a jam has occurred in the determining whether a jam has occurred step and determining that a special sound has not been generated in the determining whether a special sound has been generated step, and determining by the computer that no jam has occurred and not performing the abnormal processing, when determining that a jam has occurred in the determining whether a jam has occurred step and determining that a special sound has been generated in the determining whether a special sound has been generated step.

According to an aspect of the computer-readable, non-transitory medium storing a computer program, the computer program causes a computer to execute a process, including acquiring a sound signal, determining whether a jam has occurred based on the sound signal, determining whether a special sound has been generated based on a component of the sound signal, performing abnormal processing when determining that a jam has occurred in the determining whether a jam has occurred step and determining that a special sound has not been generated in the determining whether a special sound has been generated step, and determining by the computer that no jam has occurred and not performing the abnormal processing, when determining that a jam has occurred in the determining whether a jam has occurred step and determining that a special sound has been generated in the determining whether a special sound has been generated step.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection, and computer program according to an embodiment, will be described with reference to the drawings. However, note that the technical scope of the invention is not limited to these embodiments and extends to the inventions described in the claims and their equivalents.

Figure 1:
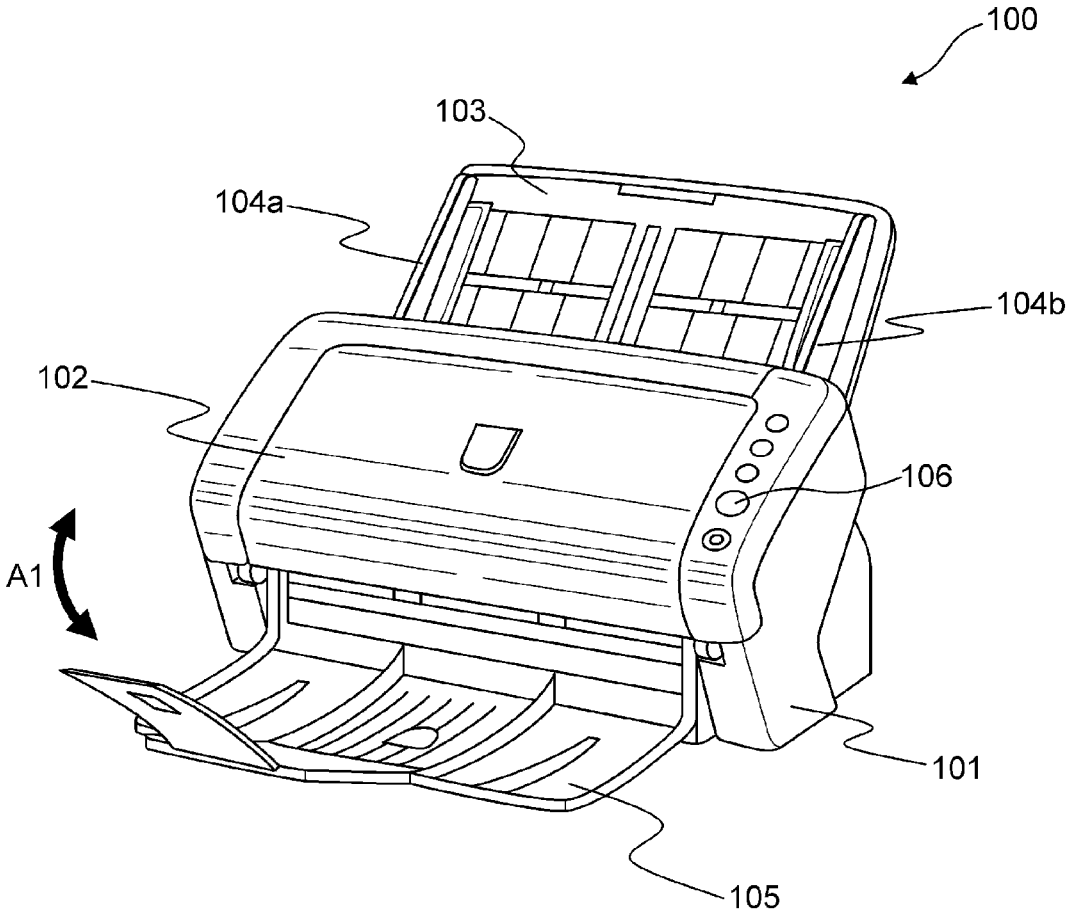
FIG. 1 is a perspective view which shows a paper conveying apparatus 100 according to an embodiment.

FIG. 1 is an exemplary embodiment of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
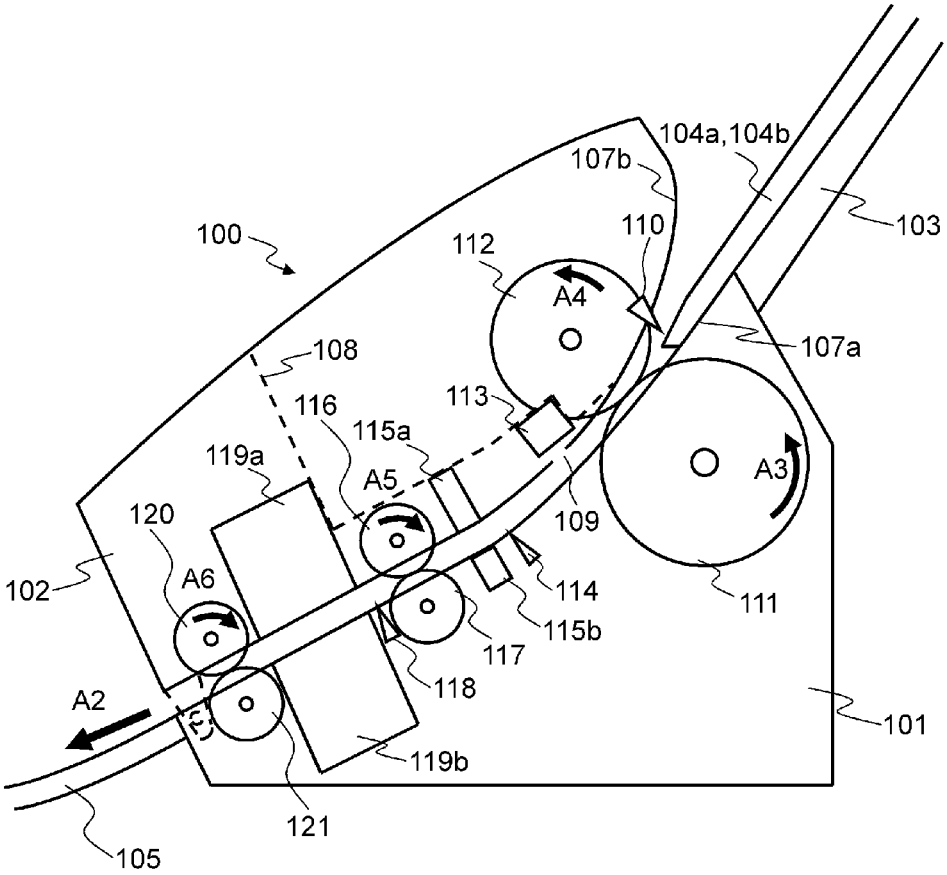
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a microphone 113, a second paper detector 114, an ultrasonic transmitter 115*a*, an ultrasonic receiver 115*b*, a first conveyor roller 116, a first driven roller 117, a third paper detector 118, a first image capture unit 119*a*, a second image capture unit 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 113 is an example of a sound detector, is provided near a conveyance path of a paper, and detects the sound generated by a paper during conveyance of the paper, and generates and outputs an analog signal corresponding to the detected sound. The microphone 113 is arranged at the downstream side of the paper feed roller 111 and the retard roller 112 while fastened to the frame 108 at the inside of the upper housing 102. A hole 109 is provided in the upper guide 107*b* facing the microphone 113, so that the sound generated by the paper during conveyance of the paper can be more accurately detected by the microphone 113.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
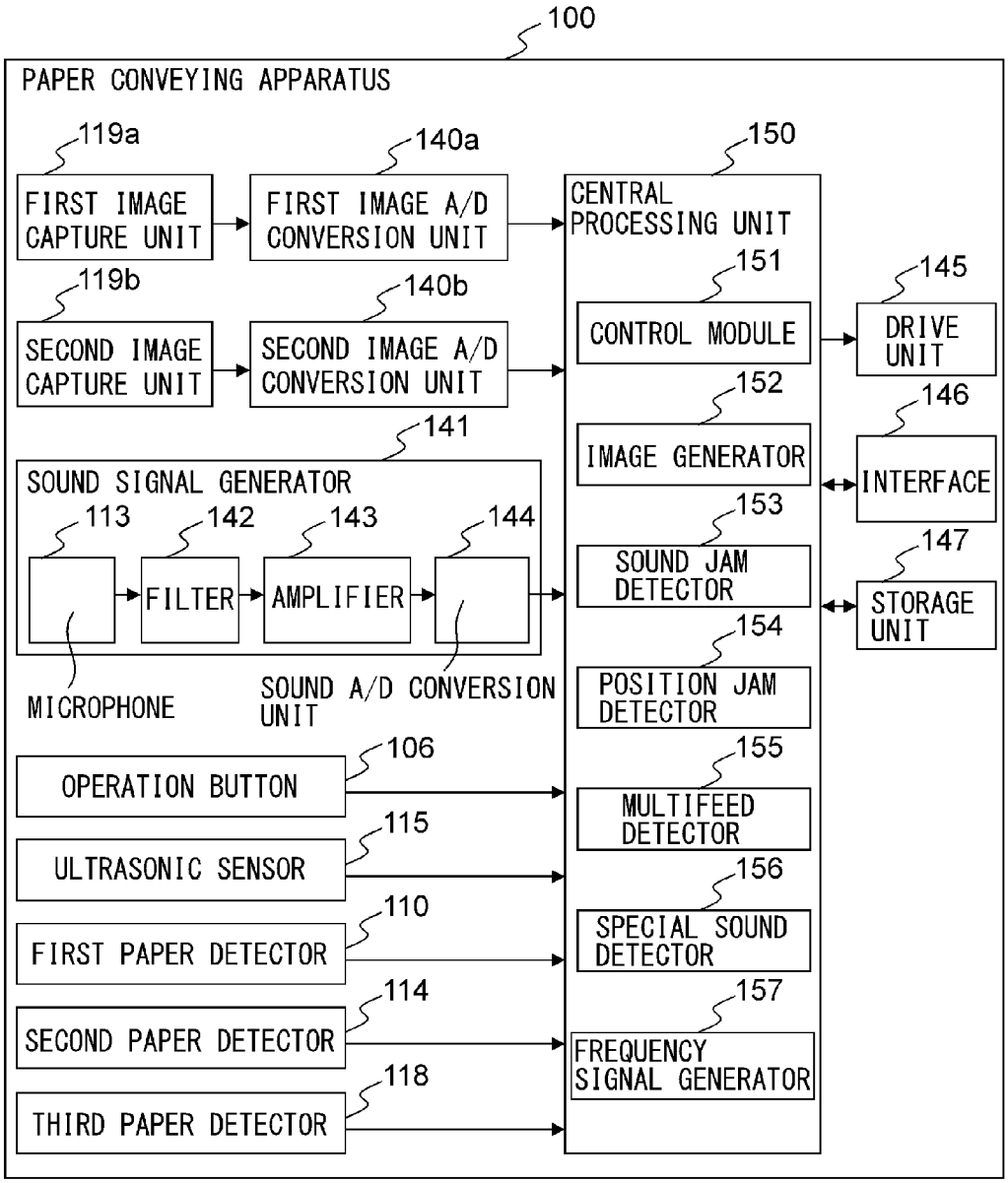
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, a filter 142, an amplifier 143, a sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 converts the analog signal which is output from the amplifier 143 to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, the amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, the retard roller 112, the first conveyor roller 116, and the second conveyor roller 120 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read images.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, a special sound detector 156, a frequency signal generator 157, etc. These units are functional modules which are realized by software which operate on a processor. Note that, these units may be comprised of respectively independent integrated circuits, a microprocessor, firmware, etc.

Figure 4:
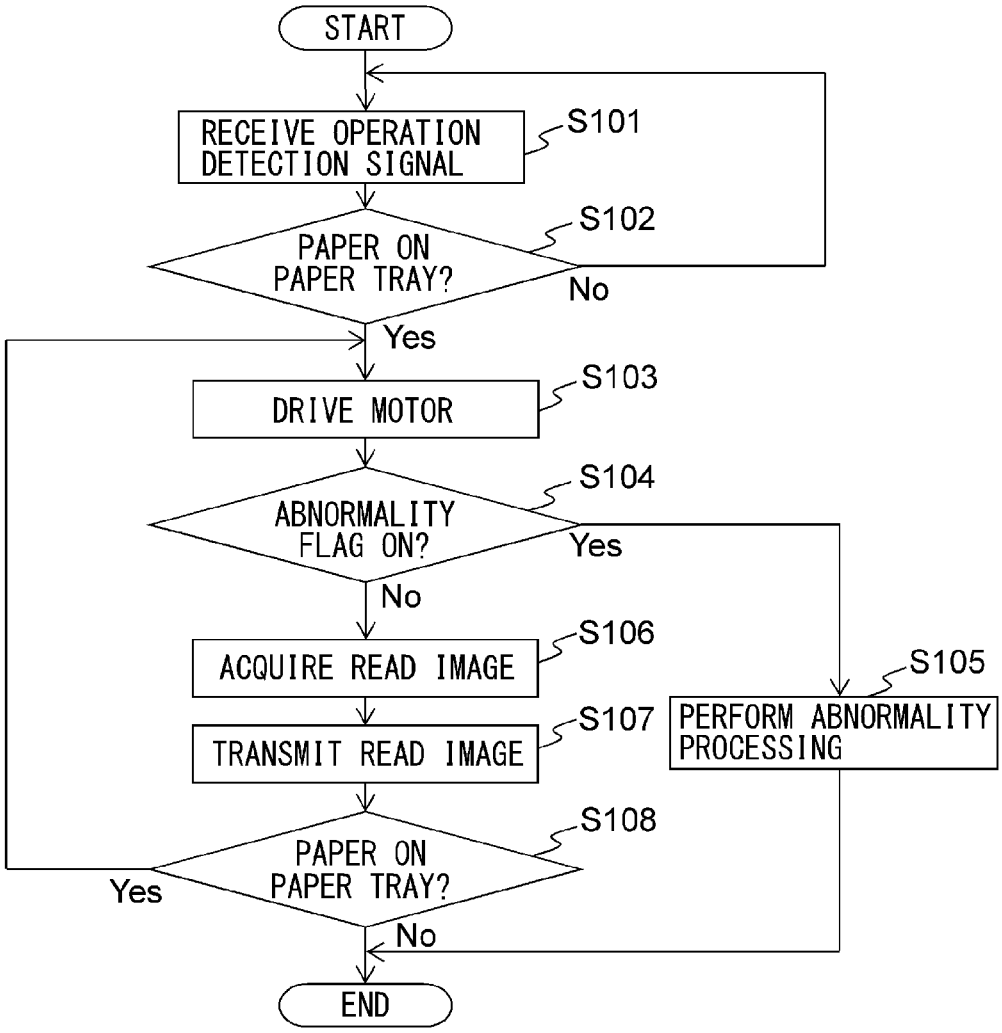
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determine whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
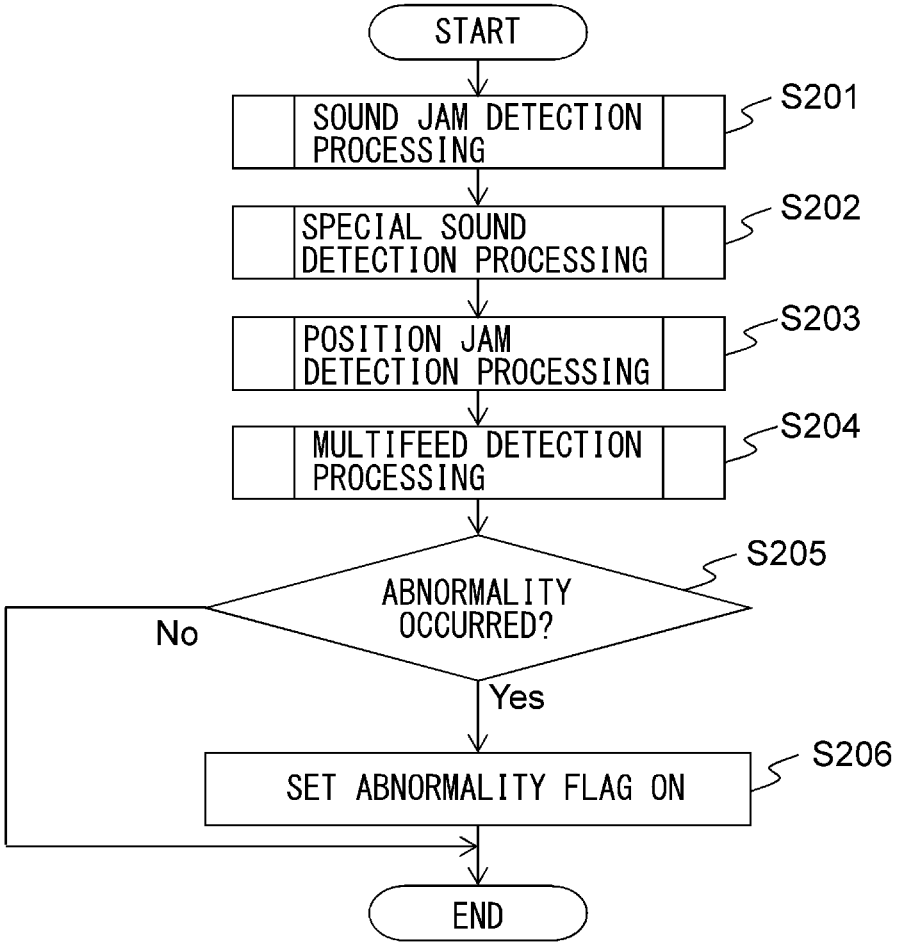
FIG. 5 is a flow chart which shows an example of an abnormality detection of the paper conveyance.

FIG. 5 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the special sound detector 156 performs special sound detection processing (step S202). The special sound detector 156 determines whether a special sound has occurred based on a component of the sound signal which was acquired from the sound signal generator 141 in the special sound detection processing. Note that, the "special sound" means a sound with a specific frequency component much larger than the other frequency components. Details of the special sound detection processing will be explained later.

Next, the position jam detector 154 performs position jam detection processing (step S203). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S204). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S205). The control module 151 determines that an abnormality has occurred if at least one of a sound jam, position jam, and paper multifeed has occurred. That is, it is determined that no abnormality has occurred when none of a sound jam, position jam, or paper multifeed has occurred. However, the control module 151 determines that a sound jam has occurred and determines that an abnormality has occurred when the sound jam detector 153 determines that a sound jam has occurred and the special sound detector 156 determines that a special sound has not been generated. On the other hand, the control module 151 determines that no sound jam has occurred and determines that no abnormality has occurred when the sound jam detector 153 determines that a sound jam has occurred and the special sound detector 156 determines that a special sound has been generated.

The control module 151 sets the abnormality flag to ON (step S206) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
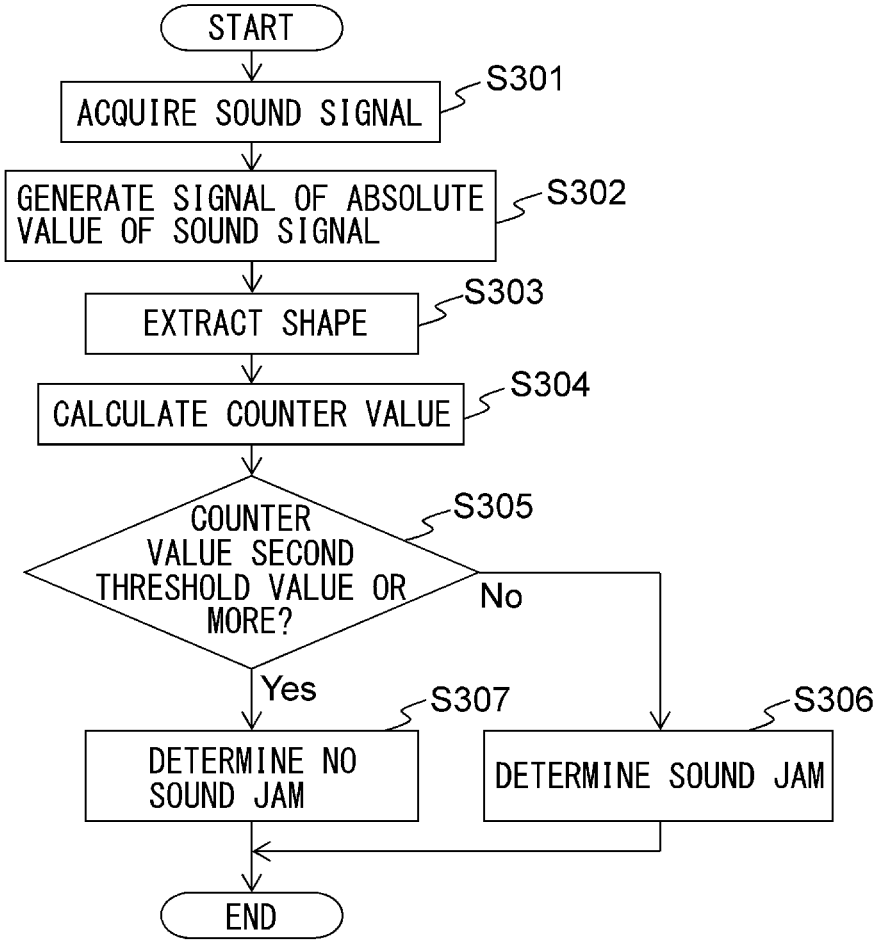
FIG. 6 is a flow chart which shows an example of operation of sound jam detection processing.

FIG. 6 is a flow chart which shows an example of operation of a sound jam judgment processing.

The flow of operation which is shown in FIG. 6 is executed at step S201 of the flow chart which is shown in FIG. 5.

First, the sound jam detector 153 acquires a sound signal from the sound signal generator 141 (step S301).

Figure 7A:
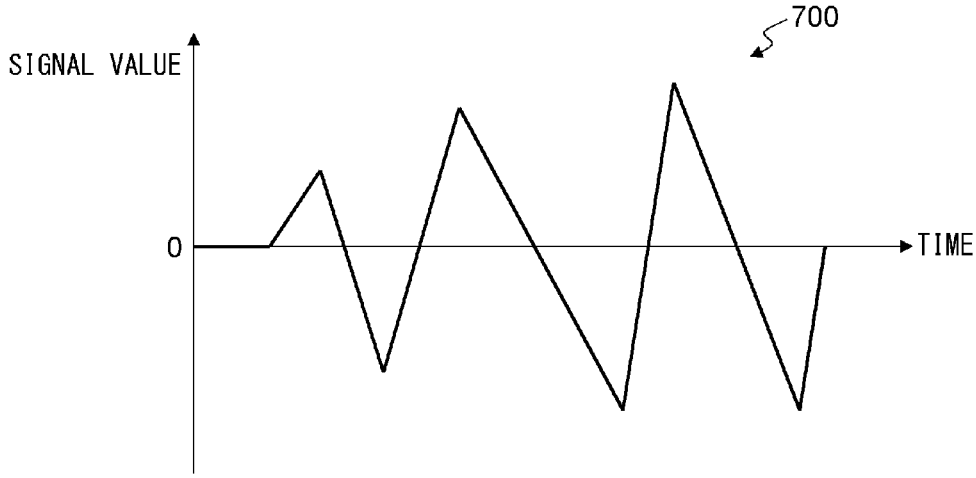
FIG. 7A is a graph which shows an example of a sound signal.

FIG. 7A is a graph which shows an example of a sound signal. The graph 700 which is shown in FIG. 7A shows a sound signal which is acquired from the sound signal generator 141. The abscissa of graph 700 shows the time, while the ordinate shows the signal value of the sound signal.

Next, the sound jam detector 153 generates a signal of the absolute value of the sound signal received from the sound signal generator 141 (step S302).

Figure 7B:
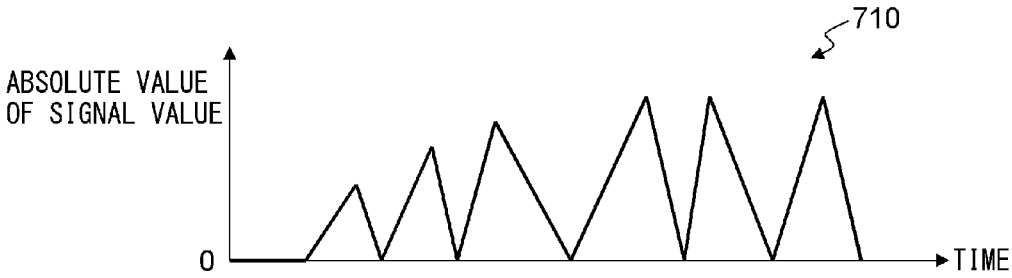
FIG. 7B is a graph which shows an example of a signal of an absolute value of a sound signal.

FIG. 7B is a graph which shows an example of the signal of the absolute value of the sound signal. The graph 710 which is shown in FIG. 7B shows the signal of the absolute value of the sound signal of the graph 700. The abscissa of graph 710 shows the time, while the ordinate shows the signal of the absolute value of the sound signal.

Next, the sound jam detector 153 extracts a shape of a signal of the absolute value of the sound signal (step S303). The sound jam detector 153 extracts the envelope as the shape of the signal of the absolute value of the sound signal.

Figure 7C:
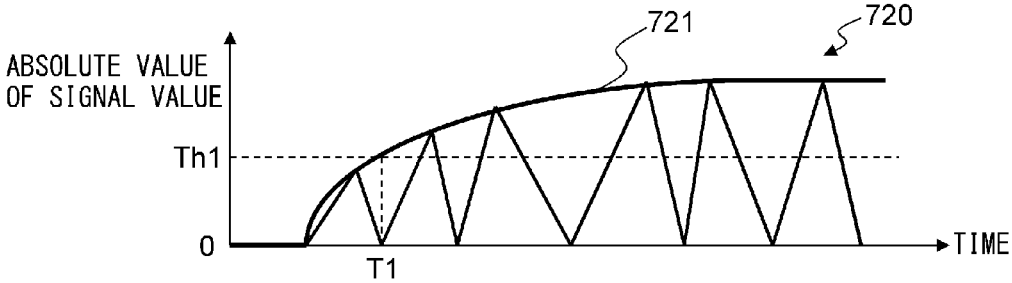
FIG. 7C is a graph which shows an example of a shape of a signal of an absolute value of a sound signal.

FIG. 7C is a graph which shows an example of the shape of a signal of the absolute value of the sound signal. The graph 720 which is shown in FIG. 7C shows the envelope 721 of the signal of the absolute value of the sound signal of the graph 710. The abscissa of the graph 720 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S304). The sound jam detector 153 determines whether the value of the envelope 721 is the first threshold value Th1 or more at each predetermined time interval (for example, sampling intervals of sound signal), increments the counter value when the value of the envelope 721 is the first threshold value Th1 or more, and decrements the counter value when it is less than the first threshold value Th1.

Figure 7D:
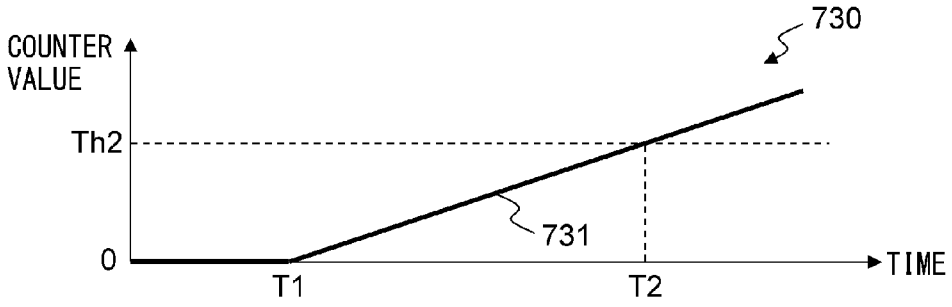
FIG. 7D is a graph which shows an example of a counter value.

FIG. 7D is a graph which shows an example of the counter value which is calculated for the shape of the signal of the absolute value of the sound signal. The graph 730 which is shown in FIG. 7D expresses the counter value which is calculated for the envelope 721 of the graph 720. The abscissa of the graph 720 shows the time, while the ordinate shows the counter value.

Next, the sound jam detector 153 determines whether the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 7C, the envelope 721 is the first threshold value Th1 or more at the time T1 and thereafter does not become less than the first threshold value Th1. For this reason, as shown in FIG. 7D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

Figure 8A:
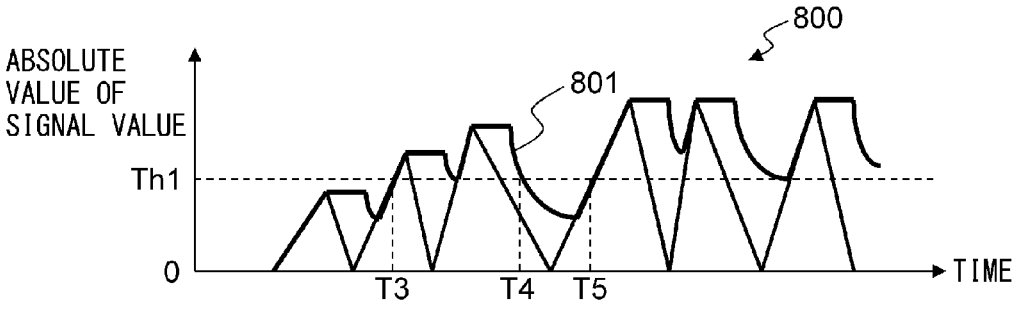
FIG. 8A is a view for explaining processing for detection of an occurrence of a jam.
Figure 8B:
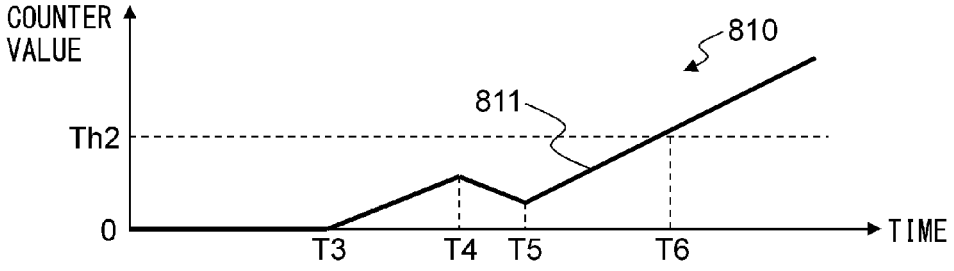
FIG. 8B is a view for explaining processing for detection of an occurrence of a jam.

FIG. 8A and FIG. 8B are views for explaining the processing for acquiring the peak hold signal from the sound signal and determining whether a sound jam has occurred.

The graph 800 which is shown in FIG. 8A expresses the peak hold signal 801 for the signal of the absolute value of the sound signal of the graph 710. The abscissa of the graph 800 shows the time, while the ordinate shows the absolute value of the signal value of the sound signal.

The graph 810 which is shown in FIG. 8B shows the counter value which was calculated for the peak hold signal 801 of the graph 800. The abscissa of the graph 810 shows the time, while the ordinate shows the counter value. The peak hold signal 801 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 8B, the counter value increases from the time T3, decreases from the time T4, again increases from the time T5, and becomes the second threshold value Th2 or more at the time T6, so it is determined that a sound jam has occurred.

Figure 9:
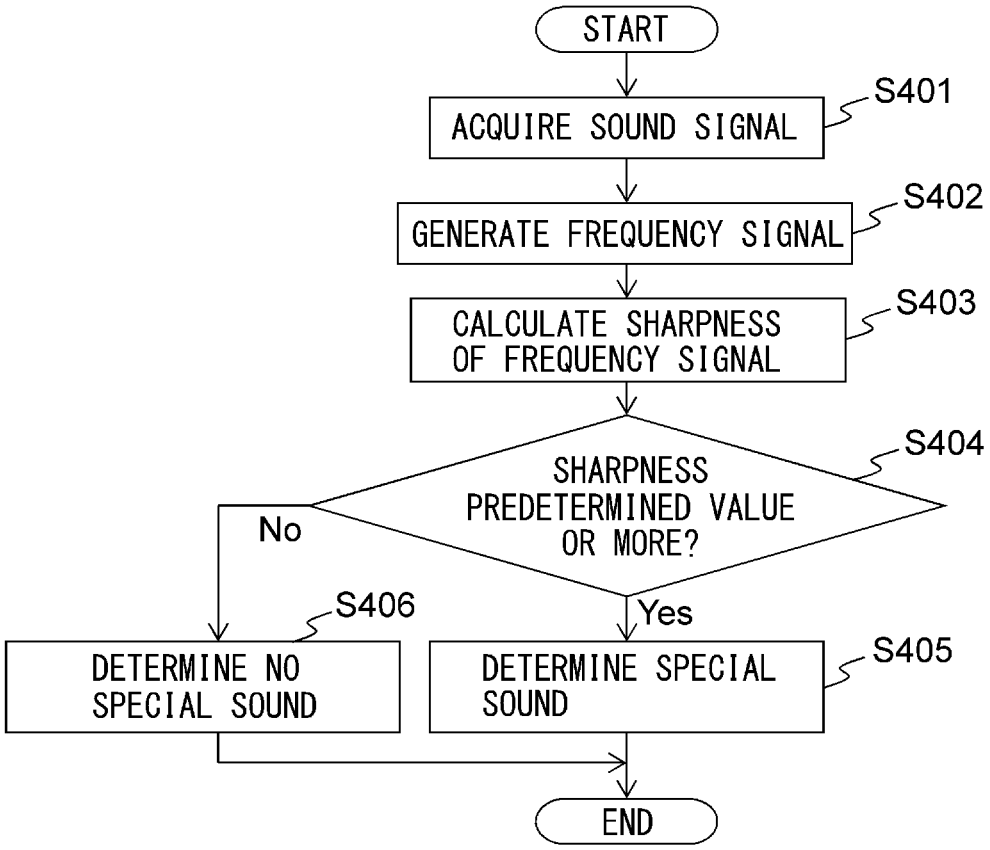
FIG. 9 is a flow chart which shows an example of operations in special sound detection processing.

FIG. 9 is a flow chart which shows an example of the operations in special sound detection processing.

The flow of operation which is shown in FIG. 9 is performed at step S202 of the flow chart which is shown in FIG. 5.

First, the frequency signal generator 157 acquires a sound signal from the sound signal generator 141 (step S401).

Next, the frequency signal generator 157 generates a frequency signal which is acquired by using a fast Fourier transform (FFT) to convert a sound signal which is received from the sound signal generator 141 to frequency (step S402).

The sound A/D conversion unit 144 samples the analog signal output by the amplifier 143 at 22 kHz to convert it to a digital format and generate a sound signal. The frequency signal generator 156 acquires 512 samples worth (94 msec worth) of the sound signal in 0 to 10000 Hz in range at 43 Hz intervals and converts them to frequency to generate a signal. The frequency signal generator 156 converts the signal acquired by converting the sound signal to frequency to decibels based on the maximum possible volume so as to generate the frequency signal.

Figure 10:
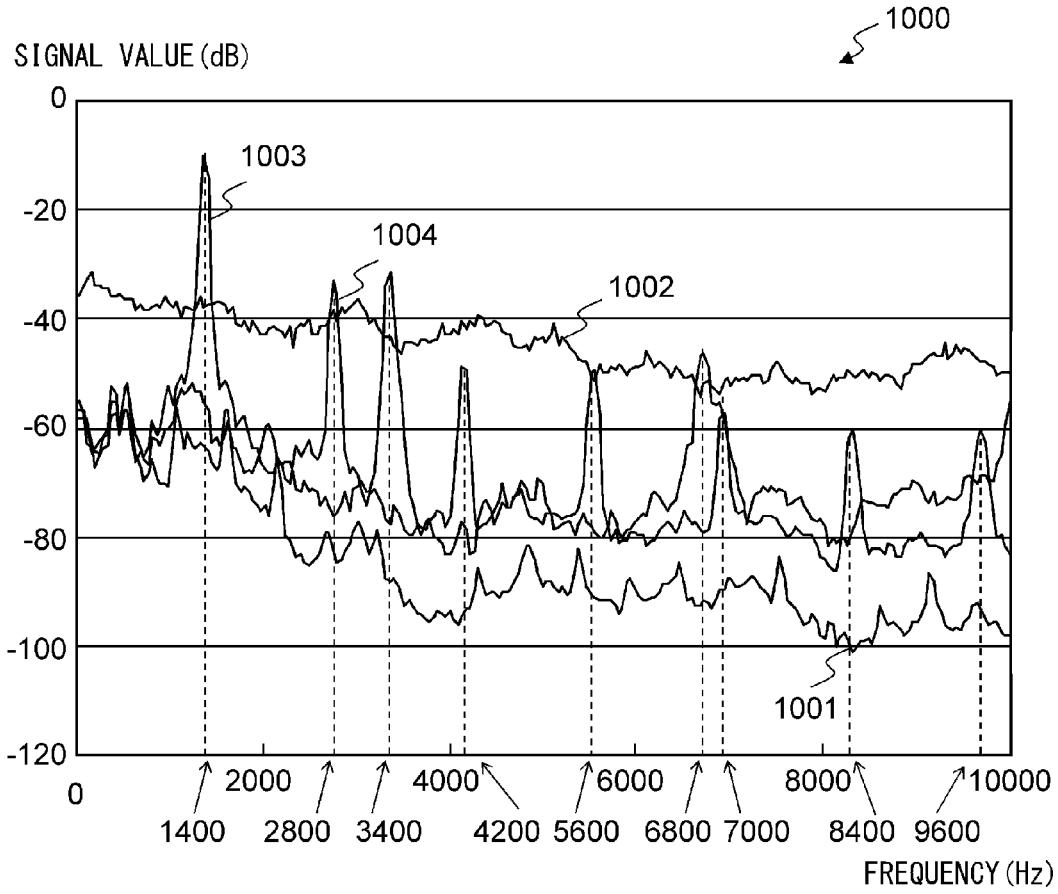
FIG. 10 is a graph which shows an example of frequency signals.

FIG. 10 is a graph which shows an example of the frequency signals. In FIG. 10, the abscissa shows the frequency, while the ordinate shows the signal value of the frequency signal. The graph 1000 of FIG. 10 shows examples of a frequency signal 1001 at the time of normal paper feed, a frequency signal 1002 at the time of occurrence of a jam, a frequency signal 1003 at the time of generation of a squeaking sound at a specific device, and a frequency signal 1004 at the time of generation of a squeaking sound at other devices.

The "squeaking sound" means the sound which is generated due to the stick-slip vibration which occurs due to the rubber members which are provided at the outer circumferential surfaces of the paper feed roller 111 and retard roller 112 contacting a paper. This stick-slip vibration causes the paper to vibrate, whereby the paper acts as a vibrating medium and the squeaking sound is amplified. The squeaking sound occurs inside the apparatus and has a magnitude equal to or greater than the sound which is generated due to a jam, so when a squeaking sound is generated, the sound jam detector 153 sometimes mistakenly determines that a jam has occurred.

As shown in FIG. 10, at the frequency signal 1003 at the time of generation of a squeaking sound, a specific frequency component (1400 Hz) and its harmonic components (2800 Hz, 4200 Hz, 5600 Hz, 7000 Hz, 8400 Hz, and 9600 Hz) become much larger than the other frequency components. In the same way, in the frequency signal 1004 as well, a specific frequency component (3400 Hz) and its harmonic component (6800 Hz) become much larger than the other frequency components. On the other hand, in the frequency signal 1001 at the time of normal feed, no tendency is seen for a specific frequency component to become much larger than the other frequency components to the extent of the frequency signal 1003 and the frequency signal 1004. Further, in the frequency signal 1002 at the time of occurrence of a jam, the frequency components at all frequency bands become larger uniformly with respect to the frequency signal 1001 at the time of normal feed. No tendency is seen for specific frequency components to become much greater than the other frequency components like with the frequency signal 1003 and the frequency signal 1004.

Next, the special sound detector 156 calculates a sharpness of the frequency signal which is generated by the frequency signal generator 157 (step S403). The "sharpness" means the degree of magnitude by which a component of a specific frequency sticks out compared with the components of other frequencies. The special sound detector 156 calculates the sharpness for components of a predetermined frequency band which includes the above specific frequency and other frequencies in a frequency signal.

The special sound detector 156 subtracts, for each frequency at 43 Hz intervals, the average value of the frequency signal at nine points of frequency centered on that frequency from the value of the frequency signal at that frequency so as to calculate the difference. The special sound detector 156 calculates the maximum value of the differences which were calculated for respective frequencies of 0 to 10000 Hz as the sharpness of the frequency signal.

Note that, the sharpness can be calculated by the following formula:

$$\boxed{\text{Sharpness}=}\max\left[P(i)-\frac{\sum_{j=i-4}^{i+4}P(j)}{9}\right]\quad(5\le i\le n-4)\tag{1}$$

where, "i" is a number which corresponds to the sampled frequency for the frequency signal, "n" is the number of sampled frequencies, and P(i) is the signal value of the frequency signal at the i-th frequency.

Next, the special sound detector 156 determines if the calculated sharpness is a predetermined value or more (step S404). The predetermined value is set to a value, based on prior experiments, which enables the sharpness when a special sound has generated and the sharpness when a special sound has not generated to be differentiated. In the present example, it is made 15.

Next, when the sharpness is the predetermined value or more, the special sound detector 156 determines that the specific frequency component is much larger than the other frequency components and determines that a special sound has been generated (step S405), then the series of steps is ended.

On the other hand, when the sharpness is less than the predetermined value, the special sound detector 156 determines that the specific frequency component is not much larger than the other frequency components and determines that no special sound has been generated (step S406), then the series of steps is ended.

In the example which is shown in FIG. 10, the sharpness of the frequency signal 1001 becomes 12 and the sharpness of the frequency signal 1002 becomes 3, so for the frequency signal 1001 and the frequency signal 1002, it is determined that no special sound has been generated. On the other hand, the sharpness of the frequency signal 1003 becomes 24 and the sharpness of the frequency signal 1004 becomes 18, so for the frequency signal 1003 and frequency signal 1004, it is determined that a special sound has been generated.

Note that, at step S403, instead of using formula (1) to calculate the sharpness, the special sound detector 156 can also calculate the sharpness from the difference between the average value of the frequency signal of a frequency band which includes a plurality of frequencies and the average value of the frequency signal of a frequency band which includes that frequency band. In this case, the special sound detector 156 subtracts, for each frequency at 43 Hz intervals, the average value of the frequency signal of the 387 Hz frequency band which includes nine points of frequency centered on that frequency from the average value of the frequency signal of a 129 Hz frequency band which includes three points of frequency centered on that frequency, so as to calculate the difference. The special sound detector 156 calculates the maximum value of the above difference which was calculated for each frequency from 0 to 10000 Hz as the sharpness of the frequency signal.

Further, at step S403, instead of using formula (1) to calculate the sharpness, the special sound detector 156 can also calculate the sharpness from the difference between the average value of the frequency signal of a frequency band which includes a plurality of frequencies and the average value of the frequency signal of the total frequency band which generates the frequency signal. In this case, the special sound detector 156 subtracts, for each frequency at 43 Hz intervals, the average value of the frequency signal of the 0 to 10000 Hz frequency band from the average value of the frequency signal of a 129 Hz frequency band which includes three points of frequency centered on that frequency so as to calculate the difference. The special sound detector 156 calculates the maximum value of the above difference which was calculated for each frequency from 0 to 10000 Hz as the sharpness of the frequency signal.

Further, at step S403, instead of using formula (1) to calculate the sharpness, the special sound detector 156 can also calculate the sharpness from the sum of the absolute values of the differences between the values of the frequency components at the frequency signal and the values of the adjoining frequency components which respectively adjoin the frequencies. In this case, the special sound detector 156 calculates, for each frequency at 43 Hz intervals, the absolute value of the difference between the value of the frequency signal at that frequency and the value of the frequency signal at a frequency adjoining that frequency (frequency 43 Hz higher than that frequency). The special sound detector 156 calculates the sum of the above absolute values of the differences calculated for the frequencies from 0 to 10000 Hz as the sharpness (see following formula (2)). In this case, the predetermined value can be made 450.

$$\boxed{\text{Sharpness}=}\sum_{i=2}^{n}|P(i)-P(i-1)|\tag{2}$$

In the example which is shown in FIG. 10, when using the formula (2), the sharpness of the frequency signal 1001 becomes 421 and the sharpness of the frequency signal 1002 becomes 265, so for the frequency signal 1001 and frequency signal 1002, it is determined that no special sound has been generated. On the other hand, the sharpness of the frequency signal 1003 becomes 676 and the sharpness of the frequency signal 1004 becomes 510, so for the frequency signal 1003 and frequency signal 1004, it is determined that a special sound has been generated.

Further, at step S403, instead of using formula (2) to calculate the sharpness, the special sound detector 156 may calculate the sharpness from the difference between the average value of the frequency signal of a frequency band which includes a plurality of frequencies and the average value of the frequency signal of a frequency band which adjoins that frequency band. In this case, the special sound detector 156 divides the 0 to 10000 Hz frequency band into 129 Hz frequency bands each including three frequencies at 43 Hz intervals. The special sound detector 156 calculates, for each divided frequency band, the absolute value of the difference between the average value of the frequency signal in that frequency band and the average value of the frequency signal in a frequency band which respectively adjoins that frequency band. The special sound detector 156 calculates the sum of the above absolute values of the differences which were calculated for the 0 to 10000 Hz divided frequency bands as the sharpness.

Further, at step S403, instead of using formula (1) to calculate the sharpness, the special sound detector 156 may calculate the sharpness from the maximum value of the absolute values of the differences between values of the frequency components at the frequency signal and the values of the adjoining frequency components which respectively adjoin the frequency components. In this case, the special sound detector 156 calculates, for each frequency at 43 Hz intervals, the absolute value of the difference between the value of the frequency signal at that frequency and the value of the frequency signal at a frequency which adjoins that frequency (frequency 43 Hz higher than that frequency). The special sound detector 156 calculates the maximum value of the above absolute values of the differences calculated for the frequencies of 0 to 100010 Hz as the sharpness (see following formula (3)). In this case, the predetermined value can be made 12.

$$\boxed{\text{Sharpness} =} \max|P(i) - P(i-1)| \quad (2 \le i \le n) \tag{3}$$

In the example which is shown in FIG. 10, when using the formula (3), the sharpness of the frequency signal 1001 becomes 10 and the sharpness of the frequency signal 1002 becomes 4, so for the frequency signal 1001 and frequency signal 1002, it is determined that no special sound has been generated. On the other hand, the sharpness of the frequency signal 1003 becomes 22 and the sharpness of the frequency signal 1004 becomes 14, so for the frequency signal 1003 and frequency signal 1004, it is determined that a special sound has been generated.

Further, at step S403, instead of using formula (3) to calculate the sharpness, the special sound detector 156 may calculate the sharpness from the difference between the average value of the frequency signal of a frequency band which includes a plurality of frequencies and the average value of the frequency signal of a frequency band which adjoins that frequency band. In this case, the special sound detector 156 divides the 0 to 10000 Hz frequency band into 129 Hz frequency bands each including three frequencies at 43 Hz intervals. The special sound detector 156 calculates, for each divided frequency band, the absolute value of the difference between the average value of the frequency signal in that frequency band and the average value of frequency signal in a frequency band which respectively adjoins that frequency band. The special sound detector 156 calculates the maximum value of the absolute values of the differences which were calculated for the divided frequency bands from 0 to 10000 Hz as the sharpness.

In the calculation of the sharpness, the sampling frequency of the sound signal, the range of frequency which generates a frequency signal, the interval of the sampled frequencies (resolution of frequency signal), and other values are not limited to the above-mentioned values and can be suitably changed. Further, the range and number of frequencies in the case of calculating the average value of the frequency signal, the predetermined value for comparison with the sharpness, the number of frequencies in the divided frequency bands in the case of dividing the frequency bands, and other values are also not limited to the above-mentioned values and can be suitably changed. Further, the frequency signal may also be made a signal which shows the absolute amount not converted to decibels.

A squeaking sound has the property that a specific frequency component and its harmonic components become much larger than the other frequency components. The degree by which a component of a specific frequency sticks out from the components of other frequencies in a frequency signal becomes larger when a squeaking sound is generated than when a squeaking sound is not generated. Therefore, as explained above, it is possible to precisely determine whether a squeaking sound has been generated by utilizing the sharpness of the frequency signal.

Figure 11:
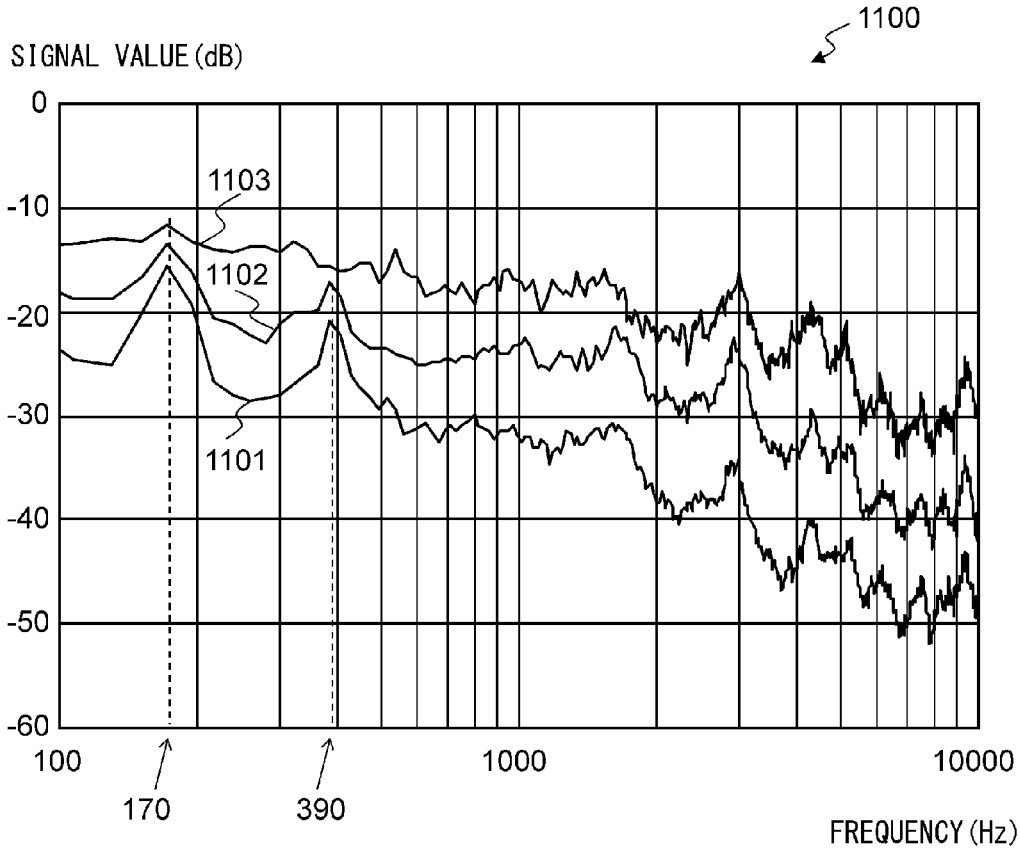
FIG. 11 is a graph which shows another example of frequency signals.

FIG. 11 is a graph which shows another example of the frequency signals. In FIG. 11, the abscissa shows a frequency by a log, while the ordinate shows a signal value of the frequency signal. The graph 1100 of FIG. 11 shows examples of a frequency signal 1101 when a normal paper which does not have wrinkles (below, referred to as "normal paper") is conveyed, a frequency signal 1102 when a paper which has wrinkles (below, referred to as "wrinkled paper") is conveyed, and a frequency signal 1103 when a jam occurs.

As shown in FIG. 11, the frequency signal 1102 is larger than the frequency signal 1101 over the entire frequency band. When wrinkled paper is conveyed, the sound jam detector 153 sometimes mistakenly determines that a jam has occurred.

When a plurality of papers are conveyed, when separating papers at the paper feed roller 111 and retard roller 112, the papers will rub against each other whereby a rubbing sound will be generated. In the frequency signal 1101 and the frequency signal 1102, due to this rubbing sound, from 100 Hz to 1000 Hz, the components of specific frequencies (170 Hz and 390 Hz) will become much larger than the components of other frequencies. On the other hand, in the frequency signal 1103 when a jam occurs, the sound which is generated by the jam masks the rubbing sound, so a tendency for a component of a specific frequency to become much larger than components of other frequencies is not seen as much as with the frequency signal 1101 and frequency signal 1102.

Therefore, for a frequency signal of the 100 Hz to 1000 Hz frequency band, by performing the special sound detection processing in accordance with the flow chart of FIG. 9, the special sound detector 156 can detect the rubbing sound when separating papers (wrinkled paper and normal paper) as a special sound.

Figure 12:
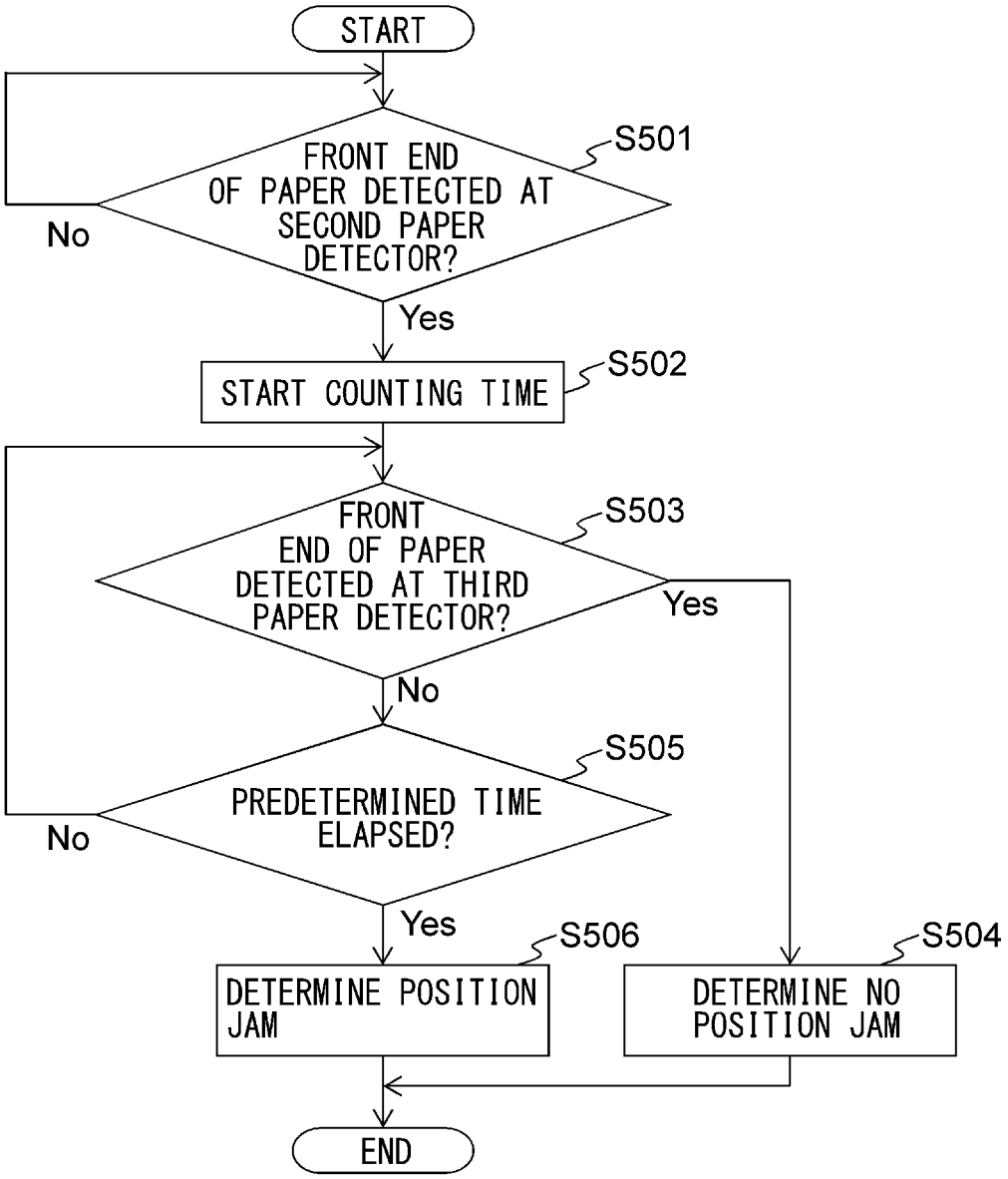
FIG. 12 is a flow chart which shows an example of operation of position jam detection processing.

FIG. 12 is a flow chart which shows an example of operation of a position jam detection processing.

The flow of operation which is shown in FIG. 12 is executed at step S203 of the flow chart which is shown in FIG. 5.

First, the position jam detector 154 stands by until the front end of the paper is detected by the second paper detector 114 (step S501). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S502).

Next, the position jam detector 154 determines whether the third paper detector 118 has detected the front end of the paper (step S503). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S504) and ends the series of steps.

On the other hand, if the third paper detector 118 detects the front end of the paper, the position jam detector 154 determines whether a predetermined time (for example, 1 second) has elapsed from the start of counting time (step S505). If a predetermined time has not elapsed, the position jam detector 154 returns to the processing of step S503 and again determines whether the third paper detector 118 has detected the front end of the paper. On the other hand, when a predetermined time has elapsed, the position jam detector 154 determines that position jam has occurred (step S506) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 13:
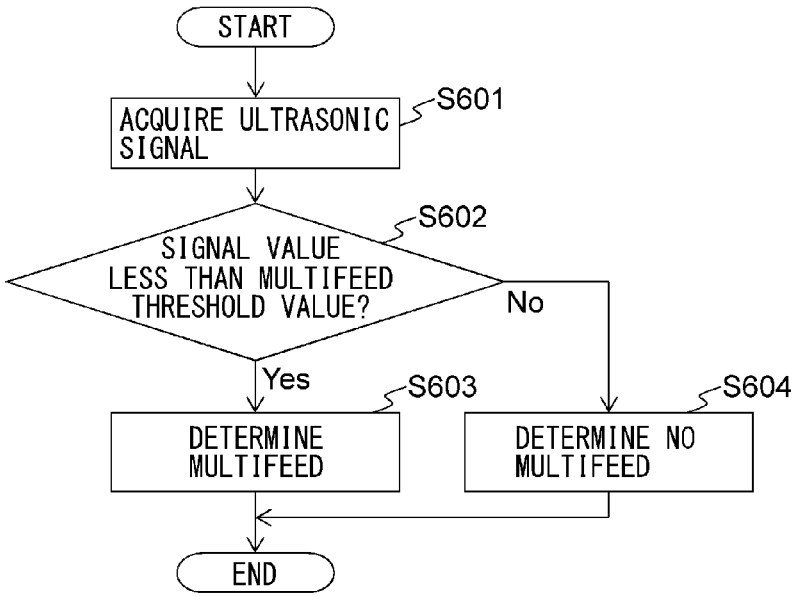
FIG. 13 is a flow chart which shows an example of operation of multifeed detection processing.

FIG. 13 is a flow chart which shows an example of operation of multifeed detection processing.

The flow of operation which is shown in FIG. 13 is executed at step S204 of the flow chart which is shown in FIG. 5.

First, the multifeed detector 155 acquires an ultrasonic signal from the ultrasonic sensor 115 (step S601).

Next, the multifeed detector 155 determines whether the signal value of the acquired ultrasonic signal is less than the multifeed detection threshold value (step S602).

Figure 14:
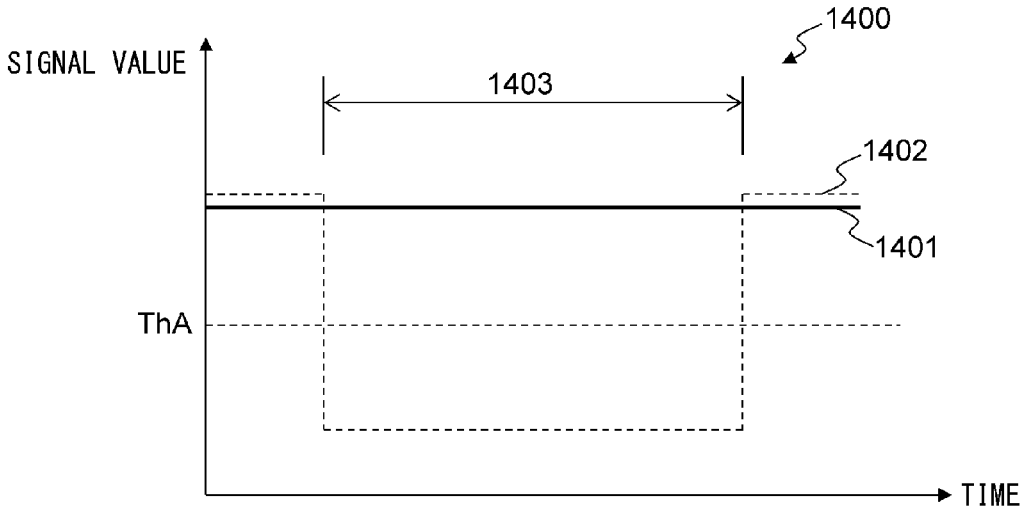
FIG. 14 a view for explaining properties of an ultrasonic signal.

FIG. 14 is a view for explaining properties of an ultrasonic signal.

In the graph 1400 of FIG. 14, the solid line 1401 shows the characteristic of the ultrasonic signal in the case where a single paper is conveyed, while the broken line 1402 shows the characteristic of the ultrasonic signal in the case where multifeed of papers has occurred. The abscissa of the graph 1400 shows the time, while the ordinate shows the signal value of the ultrasonic signal. Due to the occurrence of multifeed, the signal value of the ultrasonic signal of the broken line 1402 falls in the section 1403. For this reason, it is possible to determine whether multifeed of papers has occurred by whether the signal value of the ultrasonic signal is less than the multifeed detection threshold value ThA.

On the other hand, the solid line 1404 shows the characteristic of the ultrasonic signal in the case where just one plastic card thicker than paper is conveyed. When a card is conveyed, the signal value of the ultrasonic signal becomes smaller than the multifeed detection threshold value ThA, so the multifeed detector 155 mistakenly determines that a multifeed of papers has occurred. Note that, even if sufficiently thick, high rigidity thick paper has been conveyed, an ultrasonic signal which has characteristics similar to the case where a plastic card is conveyed is detected, so the multifeed detector 155 is liable to mistakenly determine that a multifeed of papers has occurred.

The multifeed detector 155 determines that multifeed of the papers has occurred when the signal value of the ultrasonic signal is less than the multifeed detection threshold value (step S603), determines that multifeed of the papers has not occurred when the signal value of the ultrasonic signal is the multifeed detection threshold value or more (step S604), and ends the series of steps.

As explained in detail above, the paper conveying apparatus 100 operates in accordance with the flow charts of FIG. 4, FIG. 5, FIG. 6, and FIG. 9 to thereby determine any occurrence of a jam and any generation of a special sound due to a cause other than a jam based on the sound generated by a paper during conveyance. The paper conveying apparatus 100 deems that no jam has occurred even when it is determined that a jam has occurred if that sound is a special sound, so it becomes possible to suppress mistaken detection of the occurrence of a jam.

Further, the paper conveying apparatus 100 detects a special sound based on the sharpness of a frequency signal, so can accurately detect a squeaking sound and rubbing sound at the time of paper separation as special sounds.

Figure 15:
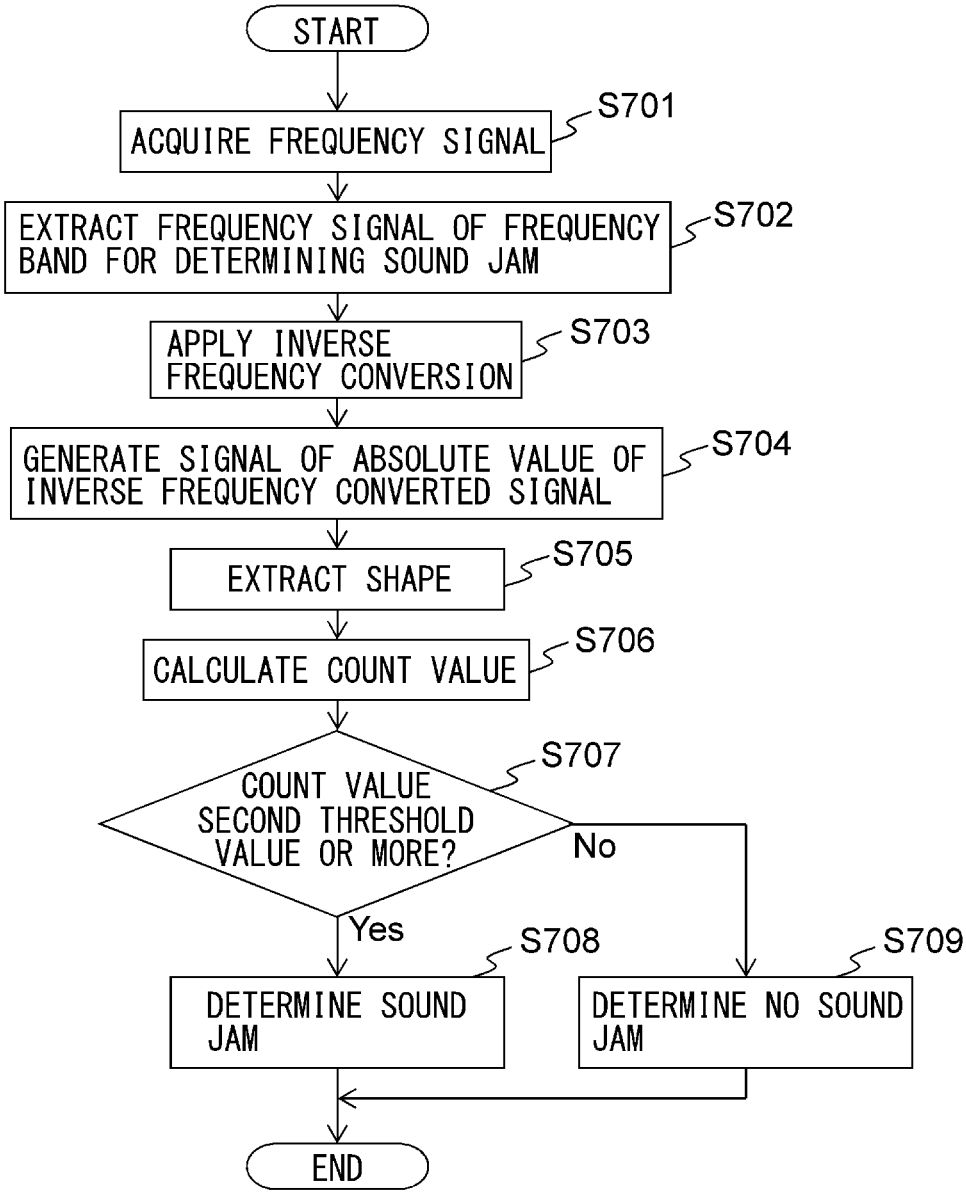
FIG. 15 is a flow chart which shows another example of operation of sound jam detection processing.

FIG. 15 is a flow chart which shows another example of the operations in the sound jam detection processing.

This flow chart can be used at the paper conveying apparatus 100 instead of the above-mentioned flow chart which is shown in FIG. 6. In the flow chart which is shown in FIG. 15, unlike the flow chart which is shown in FIG. 6, the sound jam detector 153 determines whether a jam has occurred based on a frequency component other than a frequency component which becomes larger when a special sound is generated, in the sound signal. The processing of steps S705 to S709 which are shown in FIG. 15 is the same as the processing of steps S303 to S307 which are shown in FIG. 6, so the explanation will be omitted and, below, only the processing of steps S701 to S704 will be explained. Note that, when the flow chart which is shown in FIG. 15 is used instead of the flow chart which is shown in FIG. 6, in the abnormality detection processing which is shown in FIG. 5, the special sound detection processing of step S202 is performed before the sound jam detection processing of step S201.

First, the sound jam detector 153 acquires the frequency signal from the frequency signal generator 157 (step S701).

Next, the sound jam detector 153 extracts the frequency signal of the frequency band for sound jam detection from the frequency signal which was acquired from the frequency signal generator 157 (step S702).

The sound jam detector 153 extracts a frequency band other than the frequency band for special sound detection as the frequency band for sound jam detection. Note that, a frequency band which includes nine points of frequency where the difference which was calculated at step S403 of FIG. 9 becomes the predetermined value or more which was used at step S404 becomes the frequency band for special sound detection. At the frequency band for sound jam detection, there is little influence by a squeaking sound, rubbing sound at the time of separation of a paper, and other special sounds, so the sound jam detector 153 can improve the precision of detection by determining any occurrence of a sound jam based on a frequency component of the frequency band for sound jam detection.

Next, the sound jam detector 153 generate an inverse frequency-converted signal by converting the extracted frequency signal of the frequency band for sound jam detection using an inverse fast Fourier transform (step S703).

Next, the sound jam detector 153 generates a signal which acquires the absolute value of the inverse frequency converted signal (step S704). After that, at steps S705 to S709, the sound jam detector 153 uses a signal which acquires the absolute value of the inverse frequency converted signal instead of a signal which acquires the absolute value of the sound signal so as to perform the sound jam detection processing.

Note that, at step S703, the sound jam detector 153 may also not convert the frequency signal which was extracted at step S702 to the inverse frequency, but determine whether a sound jam has occurred directly from the extracted frequency signal. In that case, the sound jam detector 153 determines that a sound jam has occurred when the average value of signal values at the different frequencies of the extracted frequency signal becomes a predetermined value or more continuously for a predetermined time or more.

Further, the frequency band where the frequency component becomes higher when a squeaking sound is generated is determined by the material, size, structure, etc., of the rubber members which are provided at the outer circumferential surfaces of the paper feed roller 111 and retard roller 112. Therefore, it is also possible run experiments in advance to investigate the frequency band at which a frequency component becomes larger when a squeaking sound is generated, set that frequency band as the frequency band for special sound detection, and set a frequency band other than the frequency band for special sound detection as the frequency band for sound jam detection.

In the same way, the frequency band where the frequency component becomes higher when a rubbing sound is generated at the time of separation of a paper is determined by the material, size, structure, etc., of the rubber members which are provided at the outer circumferential surfaces of the paper feed roller 111 and retard roller 112. Therefore, it is also possible run experiments in advance to investigate the frequency band at which a frequency component becomes larger when a paper is conveyed, set that frequency band as the frequency band for special sound detection, and set a frequency band other than the frequency band for special sound detection as the frequency band for sound jam detection.

As explained in detail above, the paper conveying apparatus 100 operates in accordance with the flow charts which are shown in FIG. 4, FIG. 5, FIG. 9, and FIG. 15 so as to determine whether a sound jam has occurred based on the frequency component of a frequency band which is little influenced by a special sound. Therefore, the paper conveying apparatus 100 can improve the precision of detection of a sound jam.

Figure 16:
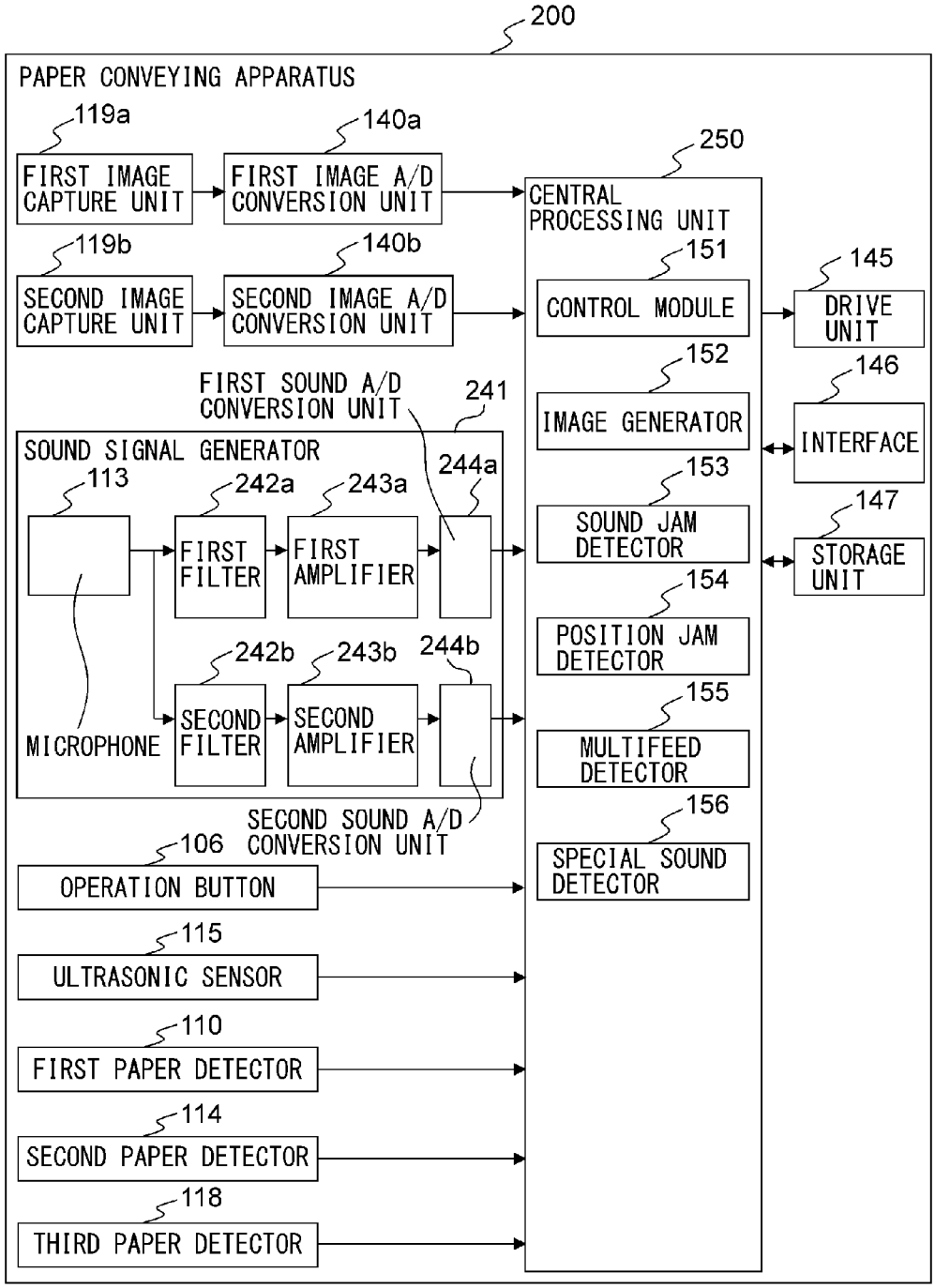
FIG. 16 is a block diagram which shows the schematic configuration of a paper conveying apparatus 200 corresponding to another embodiment.

FIG. 16 is a block diagram which shows the schematic configuration of a paper conveying apparatus 200 according to another embodiment.

The paper conveying apparatus 200 which is shown in FIG. 16 has a sound signal generator 241 instead of the sound signal generator 141 of the paper conveying apparatus 100 which is shown in FIG. 3. Further, the central processing unit 250 does not have the frequency signal generator 157.

The sound signal generator 241 includes a microphone 113, a first filter 242*a*, a second filter 242*b*, a first amplifier 243*a*, a second amplifier 243*b*, a first sound A/D conversion unit 244*a*, a second sound A/D conversion unit 244*b*, etc.

The first filter 242*a* processes the analog signal which was output from the microphone 113 by applying a bandpass filter which passes a signal of a predetermined frequency band for sound jam detection and outputs it to the first amplifier 243*a*. The first amplifier 243*a* amplifies the signal which was output from the first filter 242*a* and outputs it to the first sound A/D conversion unit 244*a*. The first sound A/D conversion unit 244*a* converts the analog signal which was output from the first amplifier 243*a* to a digital signal and outputs it to the central processing unit 250. Below, the signal which is output by the first sound A/D conversion unit 244*a* will be called the "sound signal for sound jam detection".

The second filter 242*b* processes the analog signal which is output from the microphone 113 by applying a bandpass filter which passes a signal of a predetermined frequency band for special sound detection and outputs it to the second amplifier 243*b*. The second amplifier 243*b* amplifies the signal which is output from the second filter 242*b* and outputs it to the second sound A/D conversion unit 244*b*. The second sound A/D conversion unit 244*b* converts the analog signal which was output from the second amplifier 243*b* to a digital signal and outputs it to the central processing unit 250. Below, the signal which is output by the second sound A/D conversion unit 244*b* will be called the "sound signal for special sound detection".

As explained before, it is possible to determine the frequency band for special sound detection by prior experiments and possible to determine a frequency band other than the frequency band for special sound detection as the frequency band for sound jam detection.

The sound jam detector 153 determines whether a sound jam has occurred based on the sound signal for sound jam detection.

The special sound detector 156 determines whether a special sound has been generated based on the sound signal for special sound detection. The special sound detector 156 determines that a special sound has been generated when the signal value of the sound signal for special sound detection becomes a predetermined value or more continuously for a predetermined time.

Note that, in the paper conveying apparatus 200, the microphone for detecting sound for sound jam detection and the microphone for detecting sound for special sound detection may be separately provided. In this case, the microphone for sound jam detection is arranged near a side wall of the paper conveyance path which the paper contacts and where a jam easily occurs, while the microphone for special sound detection is arranged near the paper feed roller 111 and retard roller 112 where a squeaking sound and rubbing sound of wrinkled paper generate.

The microphone for sound jam detection also detects some of the squeaking sound and rubbing sound of wrinkled paper, but the ratio of the squeaking sound and rubbing sound of wrinkled paper to the sound which is generated due to a jam becomes small. Therefore, in the sound signal for sound jam detection, by setting a threshold value between the magnitude of the sound which is generated due to a jam and the magnitude of the squeaking sound and rubbing sound of wrinkled paper and cutting the components of that threshold value or less, it is possible to eliminate the effects of the squeaking sound and rubbing sound of wrinkled paper.

In the same way, the microphone for special sound detection detects some of the sound which is generated due to a jam, but the ratio of the sound which is generated due to a jam to the squeaking sound and rubbing sound of wrinkled paper becomes small. Therefore, in the sound signal for special sound detection, by setting a threshold value between the magnitude of the squeaking sound and rubbing sound of wrinkled paper and the magnitude of sound which is generated due to a jam and cutting the components of that threshold value or less, it is possible to eliminate the effects of a sound which is generated due to a jam.

As explained in detail above, the paper conveying apparatus 200 determines whether a special sound has been generated based on the sound signal which is processed by using a filter for special sound detection and determines whether a sound jam has occurred based on the sound signal which is processed by using a filter for sound jam detection. Therefore, the paper conveying apparatus 200 can more precisely detect a special sound and can more precisely detect a sound jam when the frequency band at which the frequency component becomes higher when a special sound is generated is known in advance.

Furthermore, in the paper conveying apparatus 200, the microphone for detecting a sound for sound jam detection and the microphone for detecting a sound for special sound detection are arranged separately at positions enabling good detection of the respective sounds. Therefore, the paper conveying apparatus 200 can precisely detect a special sound and can more precisely detect a sound jam.

According to the paper conveying apparatus and the jam detection method, and the computer-readable, non-transitory medium, even when determining that a jam has occurred based on a sound generated by a paper during conveyance, if that sound is a special sound, it is deemed that no jam has occurred, so it becomes possible to suppress mistaken detection of the occurrence of a jam.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator, provided with a sound detector near a conveyance path of a paper, for generating sound signals of time series corresponding to a sound generated by the paper during conveyance of the paper;

a sound jam detector for determining whether a jam has occurred based on a shape of the sound signals;

a frequency signal generator for generating a frequency signal by converting the sound signals to frequency components;

a special sound detector for determining whether a special sound has been generated based on a component of a predetermined frequency band of the frequency signal; and a control module for performing abnormal processing based on the jam detection by the sound jam detector, wherein the control module determines that a jam has not occurred and does not perform the abnormal processing when the sound jam detector determined that the jam has occurred and the special sound detector determined that the special sound has been generated.

2. The paper conveying apparatus according to claim 1, wherein the sound jam detector determines whether a jam has occurred also based on a component of another frequency band which is different from the predetermined frequency band.

3. The paper conveying apparatus according to claim 1, wherein the special sound detector determines whether a special sound has been generated based on a difference between a first average value of the frequency signal at a first frequency band and a second average value of said frequency signal at a second frequency band which includes the first frequency band.

4. The paper conveying apparatus according to claim 1, wherein the special sound detector determines whether a special sound has been generated based on a difference between values of frequency components of the frequency signal and values of adjoining frequency components which respectively adjoin the frequency components.

5. The paper conveying apparatus according to claim 1, wherein the special sound detector determines whether a special sound has been generated based on a sum of differences between values of frequency components of the frequency signal and values of adjoining frequency components which respectively adjoin the frequency components.

6. The paper conveying apparatus according to claim 1, wherein the special sound detector determines whether a special sound has been generated based on a maximum value of differences between values of frequency components of the frequency signal and values of adjoining frequency components which respectively adjoin the frequency components.

7. The paper conveying apparatus according to claim 1, wherein the shape of the sound signals is an envelope of the sound signals.

8. The paper conveying apparatus according to claim 1, wherein the shape of the sound signals is a signal of the peak hold for the sound signals.

9. A paper conveying apparatus comprising:

a sound signal generator, provided with a sound detector near a conveyance path of a paper, for generating sound signals of time series corresponding to a sound generated by the paper during conveyance of the paper;

a filter for a first frequency band and a filter for a second frequency band which is different from the first frequency band;

a sound jam detector for determining whether a jam has occurred based on a shape of the sound signals processed by using the filter for a first frequency band;

a special sound detector for determining whether a special sound has been generated based on the sound signals processed by using the filter for a second frequency band; and a control module for performing abnormal processing based on the jam detection by the sound jam detector, wherein the control module determines that a jam has not occurred and does not perform the abnormal processing when the sound jam detector determined that the jam has occurred and the special sound detector determined that the special sound has been generated.

10. A computer-readable, non-transitory medium storing a computer program, wherein the computer program causes a computer to perform a process, the process comprising:

acquiring sound signals of time series corresponding to a sound generated by a paper during conveyance of the paper from a sound signal generator, provided with a sound detector near a conveyance path of a paper, for generating the sound signals;

determining whether a jam has occurred based on a shape of the sound signals;

generating a frequency signal by converting the sound signals to frequency components;

determining whether a special sound has been generated based on a component of a predetermined frequency band of the frequency signal; and performing abnormal processing based on the jam detection in the jam determining step, wherein the computer determines that a jam has not occurred and does not perform the abnormal processing when determining that the jam has occurred in the jam determining step and determining that the special sound has been generated in the special sound determining step, in the performing step.

11. A computer-readable, non-transitory medium storing a computer program, wherein the computer program causes a computer to perform a process, the process comprising:

acquiring sound signals of time series corresponding to a sound generated by a paper during conveyance of the paper from a sound signal generator, provided with a sound detector near a conveyance path of a paper, for generating the sound signals;

determining whether a jam has occurred based on a shape of the sound signals processed by using a filter for a first frequency band;

determining whether a special sound has been generated based on the sound signals processed by using a filter for a second frequency band which is different from the first frequency band; and performing abnormal processing based on the jam detection in the jam determining step, wherein the computer determines that a jam has not occurred and does not perform the abnormal processing when determining that the jam has occurred in the jam determining step and determining that the special sound has been generated in the special sound determining step, in the performing step.

* * * * *